US010550605B2

(12) United States Patent
Perdue et al.

(10) Patent No.: US 10,550,605 B2
(45) Date of Patent: Feb. 4, 2020

(54) DOOR AND FRAME WITH REPLACEABLE SECTIONS

(71) Applicants: John Quince Perdue, Salem, VA (US); Patrick A. Herndon, Salem, VA (US)

(72) Inventors: John Quince Perdue, Salem, VA (US); Patrick A. Herndon, Salem, VA (US)

( * ) Notice: Subject to any disclaimer, the term of this patent is extended or adjusted under 35 U.S.C. 154(b) by 65 days.

(21) Appl. No.: 15/662,868

(22) Filed: Jul. 28, 2017

(65) Prior Publication Data

US 2019/0032370 A1 Jan. 31, 2019

(51) Int. Cl.

| | |
|---|---|
| ***E06B 7/00*** | (2006.01) |
| ***E05B 63/00*** | (2006.01) |
| ***E06B 1/18*** | (2006.01) |
| ***E06B 1/52*** | (2006.01) |
| *E06B 1/64* | (2006.01) |
| *E06B 1/68* | (2006.01) |

(52) U.S. Cl.

CPC ..... *E05B 63/0065* (2013.01); *E06B 1/18* (2013.01); *E06B 1/52* (2013.01); *E06B 1/64* (2013.01); *E06B 1/68* (2013.01)

(58) Field of Classification Search

CPC ..... E05B 63/0065; E06B 1/18; E06B 1/52; E06B 1/68; E06B 1/64; G09B 9/003; G09B 9/00; G09B 19/003; G09B 19/00; A62C 99/0081

USPC ..... 49/37, 501, 463; 434/219, 226

See application file for complete search history.

(56) References Cited

U.S. PATENT DOCUMENTS

| | | | | |
|---|---|---|---|---|
| 4,118,827 | A * | 10/1978 | Yamamoto | E05D 5/04 16/252 |
| 5,906,493 | A * | 5/1999 | Bishop | G09B 9/00 292/357 |
| 7,789,666 | B2 * | 9/2010 | Sovine | G09B 9/003 434/226 |
| 8,128,408 | B2 * | 3/2012 | Phillips | G09B 19/00 434/219 |
| 8,408,917 | B2 * | 4/2013 | Perrone | G09B 19/003 434/226 |
| 9,181,735 | B2 * | 11/2015 | Troxell | E05B 17/0062 |
| 9,550,082 | B2 * | 1/2017 | Britton | A62C 99/0081 |
| 10,147,337 | B2 * | 12/2018 | Perrone | G09B 19/24 |
| 2005/0050816 | A1 * | 3/2005 | Manning | E06B 5/11 52/213 |
| 2006/0240391 | A1 * | 10/2006 | Sovine | G09B 9/003 434/219 |

* cited by examiner

*Primary Examiner* — Chi Q Nguyen

(74) *Attorney, Agent, or Firm* — Dunlap Bennett & Ludwig PLLC

(57) ABSTRACT

A lock installation training aid. The training aid includes a door having a front surface, a rear surface and an edge having a top a bottom, a first side and a second side. A first cutout is formed at the edge. A first bracket is secured to the door adjacent to the first cutout. A first door insert is disposed within the first cutout and is secured to the first bracket by fasteners.

7 Claims, 4 Drawing Sheets

DOOR AND FRAME WITH REPLACEABLE SECTIONS

BACKGROUND OF THE INVENTION

The present invention relates to lock installation training and, more particularly, to a door and frame with replaceable sections for hardware and lock installation practice.

Currently there is no way to effectively practice installing door hardware in a lab environment that simulates real world door and frame applications. This means that training is largely done in the field in an apprenticeship model, rather than a controlled predictable classroom model in which the order and type training is determined ahead of time, and a trainer is able to verify and certify mastery of a skill.

The best current alternative is to install locks on the cheapest door possible to minimize expenses, and install locks in as many configurations as possible before the door cannot be drilled anymore. Then the door and/or frame is replaced and discarded. The other option is to have a technician apprentice in the field working on real doors. This is often more difficult because there is not a controlled environment, and the workflow dictates the flow of training and topics covered.

As can be seen, there is a need for a door and frame made for practicing installation of lock hardware.

SUMMARY OF THE INVENTION

In one aspect of the present invention, a training aid comprises: a door comprising a front surface, a rear surface and an edge comprising a top, a bottom, a first side and a second side, wherein a first cut out is formed at the edge; a first bracket secured to the door adjacent to the first cut out; and a first door insert disposed within the first cut out and secured to the first bracket by a fastener.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a door and frame with replaceable cutouts to practice installing locks and door hardware. This door and frame allows for a trainee to repeatedly install door hardware and locks from scratch, without damaging a door or frame. When the work is done the section of the door or frame is simply replaced with a new insert, and the installation process can be repeated indefinitely.

Figure 1:
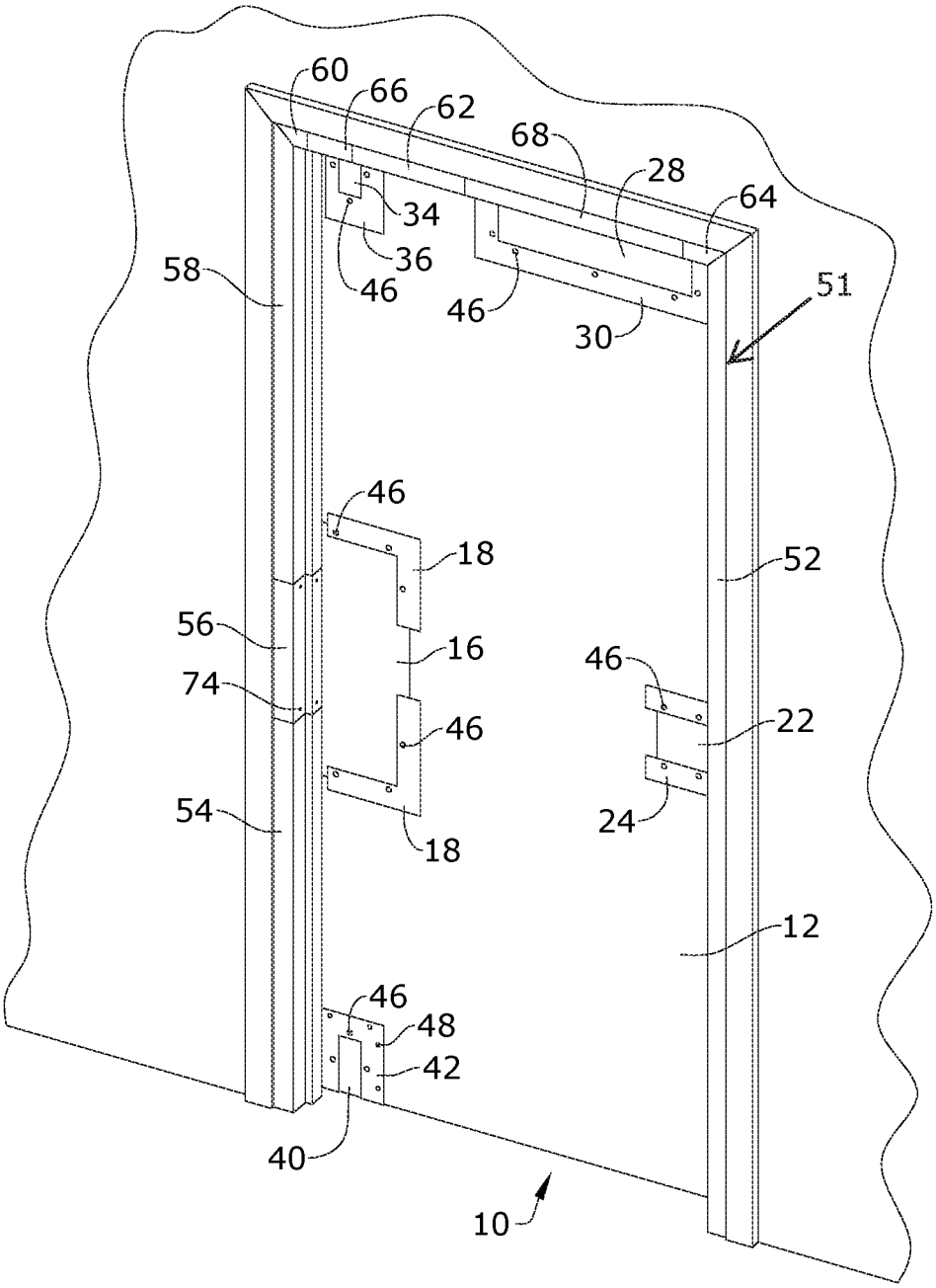
FIG. 1 is a perspective view of an embodiment of the present invention.
Figure 2:
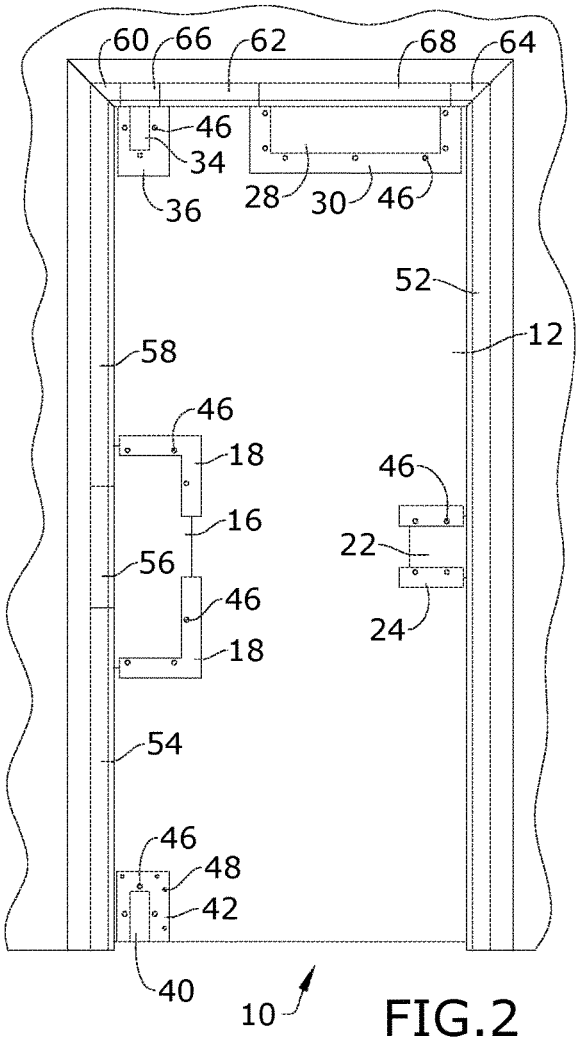
FIG. 2 is a front view of an embodiment of the present invention.
Figure 3:
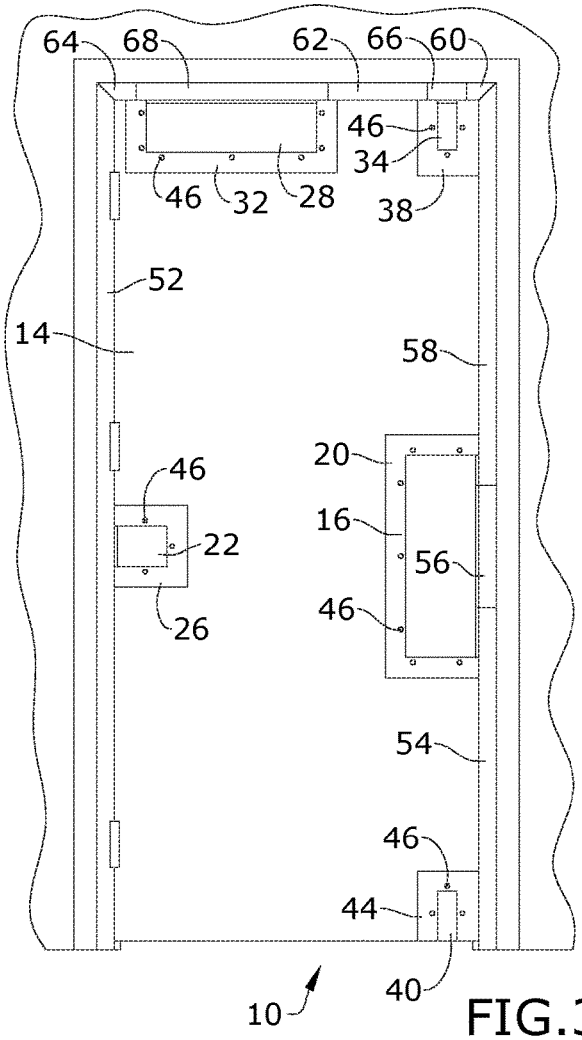
FIG. 3 is a rear view of an embodiment of the present invention.
Figure 4:
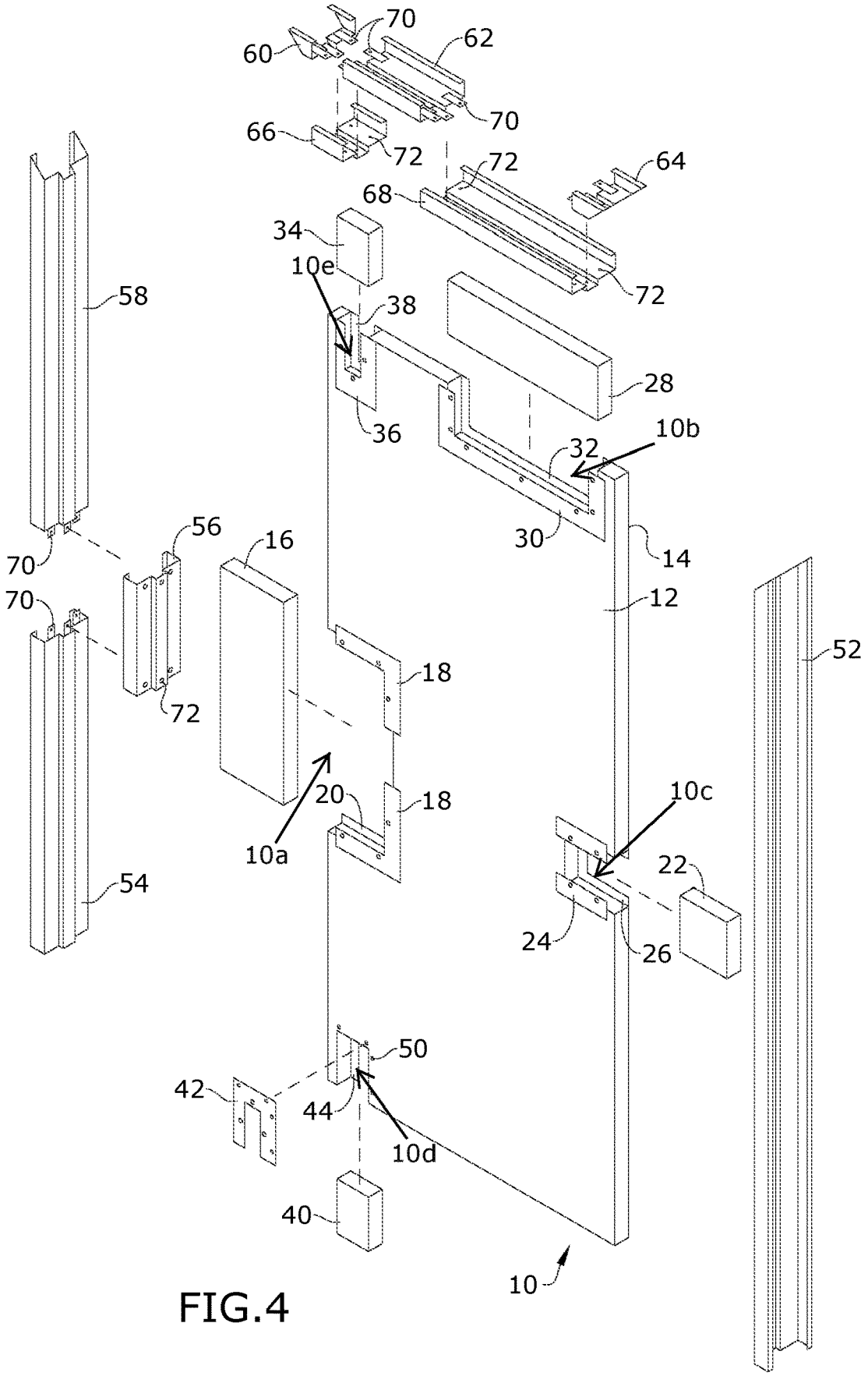
FIG. 4 is an exploded view of an embodiment of the present invention illustrated without fasteners.
Figure 5:
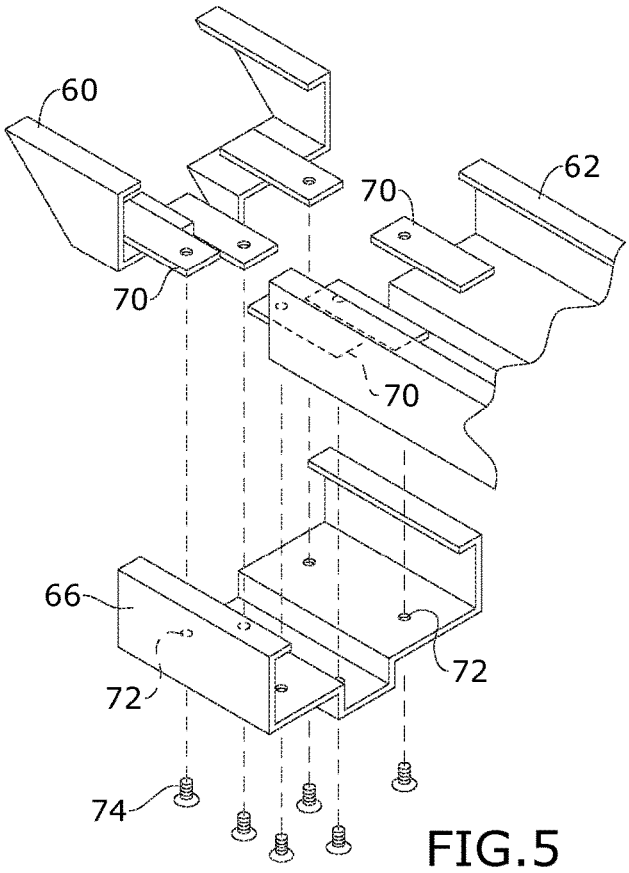
FIG. 5 is a detail exploded view of an embodiment of the present invention.
Figure 6:
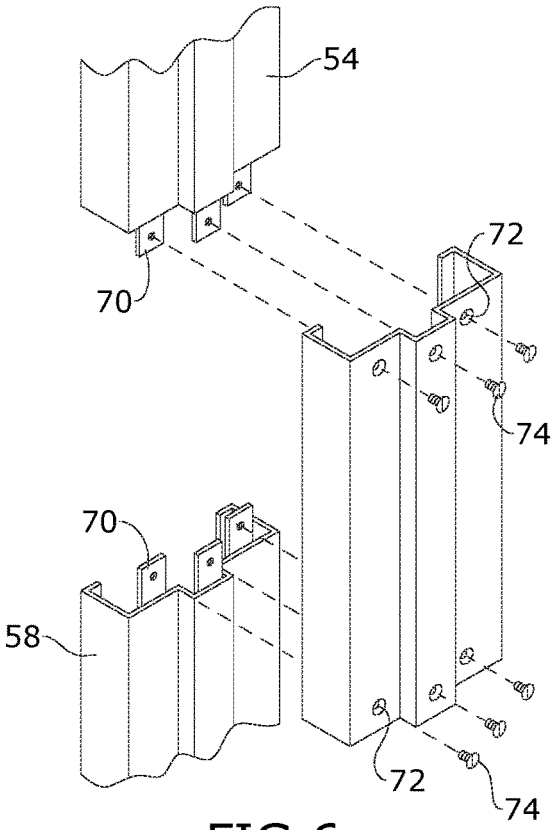
FIG. 6 is a detail exploded view of an embodiment of the present invention.
Figure 7:
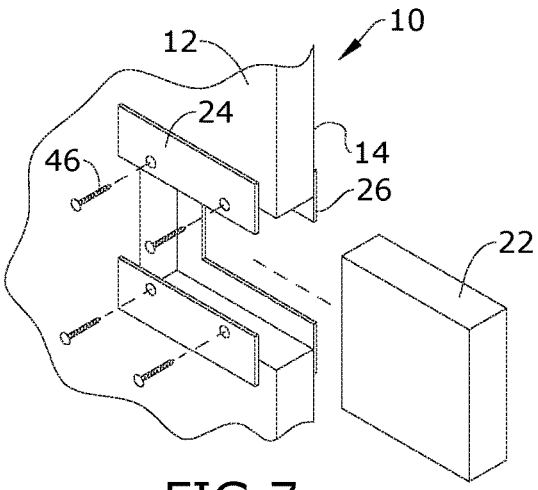
FIG. 7 is a detail exploded view of an embodiment of the present invention.
Figure 8:
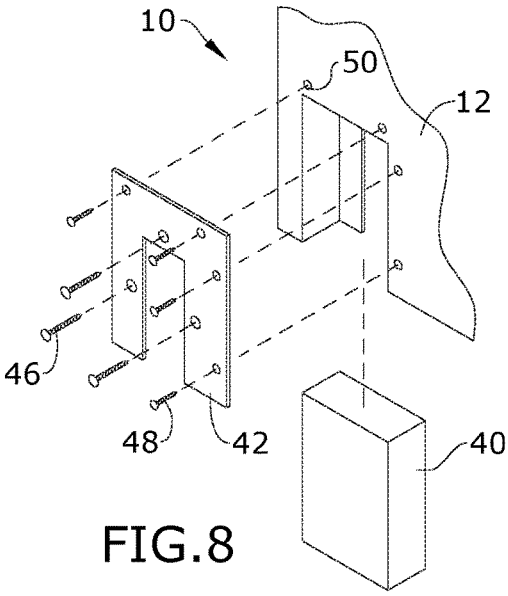
FIG. 8 is a detail exploded view of an embodiment of the present invention.

Referring to FIGS. 1 through 8, the present invention includes a training aid. The training aid includes a door 10 having a front surface 12, a rear surface 14 and an edge having a top, a bottom, a first side and a second side. A first cutout 10*a* is formed at the edge. A first bracket 18, 20 is secured to the door 10 adjacent to the first cutout 10*a*. A first door insert 16 is disposed within the first cutout 10*a* and is secured to the first bracket by fasteners 46, such as bolts and screws.

The present invention further includes a door frame 51. The door frame 51 includes a first upright 52, a second upright 54, 56, 58 and a top 60, 62, 64, 66, 68. The door 10 is connected to the first upright 52 by hinges. The door frame 51 may include permanently affixed sections that may be welded onto frame reinforcements, as well as sections that are removable and attached via fasteners 74, such as bolts and screws. When the permanently affixed sections and removable sections are mounted, the present invention may create a functional hollow metal double rabbit style frame.

The door 10 may include a wood door or a reinforced hollow metal door with reinforced cutouts strategically placed where industry standard hardware is typically mounted. The door 10 has reinforced mounting brackets on the surface that allow the door to hold the replaceable door inserts. In certain embodiments, the door 10 may include the first cutout 10*a* at the second side, a second cutout 10*b* out at the top, a third cutout 10*c* at the first side, a fourth cutout 10*d* at the bottom, and a fifth cutout 10*e* out at the top. The door inserts include an outer edge that corresponds with the inner edge of the cutouts. For example, the door inserts and the cutouts may be square or rectangular shaped. The first door insert 16 fits within the first cutout 10*a*, a second door insert 28 fits within the second cutout 10*b*, a third door insert 22 fits within the third cutout 10*c*, a fourth door insert 40 fits within the fourth cutout 10*d* and a fifth door insert 34 fits within the fifth cutout 10*e*.

As mentioned above, brackets may be used to releasably secure the door inserts within the cutouts. The first bracket 18, 20 may include a first pair of L-shaped plates 18 fixedly secured to the front surface 12 of the door 10 and a second pair of L-shaped plates 20 fixedly secured to the rear surface 14 of the door. A second bracket 24, 26 may include a first pair of plates 24 fixedly secured to the front surface 12 of the door 10 and a second pair of plates 26 fixedly secured to the rear surface 14 of the door 10. The third bracket 30, 32 may include a first U-shaped plate 30 fixedly secured to the front surface 12 of the door 10 and a second U-shaped plate 32 fixedly secured to the rear surface 14 of the door 10. The fourth bracket 42, 44 may include a first U-shaped plate 42 releasably secured to the front surface 12 of the door 10 by fasteners 48, such as bolts and screws, running through openings formed in the first U-shaped plate 42 and through openings 50 formed through the front surface 12 of the door 10 and a second U-shaped plate 44 fixedly secured to the rear surface 14 of the door 10. The fifth bracket 36, 38 may include a first U-shaped plate 36 fixedly secured to the front surface 12 of the door 10 and a second U-shaped plate 38 fixedly secured to the rear surface 14 of the door 10. Each of the plates of the brackets include a portion extending beyond an inner edge of the respective cut outs. The portion includes openings sized to receive fasteners 46 therethrough. The fasteners 46 are driven through the openings of the brackets and into the inserts, thereby releasably securing the inserts within the cutouts.

As mentioned above, the door frame 51 may include permanently affixed portions and removeable portions. In certain embodiments, the second upright may include a lower member 54, an upper member 58 and a detachable member 56 secured to the upper member and the lower member by fasteners 74. The lower member 54 and the upper member 58 may be permanently affixed. The detachable member 56 aligns with with the first cut out. The top of the door frame 51 may include a first corner 60, a first detachable member 66, a middle member 62, a second detachable member 68, and a second corner 64. The first corner 60, the middle member 62 and the second corner 64 may be permanently affixed. The first detachable member 66 may be secured to the first corner 60 and the middle member 62 by fasteners 74. The second detachable member 72 may be secured to the middle member 62 and the second corner 64 by fasteners 74. The first detachable member 66 may align with the fifth cutout and the second detachable member may align with the second cutout. In certain embodiments, the permanently affixed portions may each include tabs 70 protruding from ends, the tabs 70 having openings. The detachable members may each include openings 72 that align with the openings of the tabs 70. The fasteners 74 may run through the aligned openings, thereby releasably securing the detachable portions to the permanently affixed portions.

When the door and frame inserts are installed, these pieces allow for the installation of the door hardware to be mounted to the door inserts of the door, and function by locking and interacting with hardware mounted to the removable sections of the frame to simulate a working door and frame. Then the process is reversed and the door hardware is removed. The screws securing the inserts to the door are removed from the mounting brackets, and the removable door inserts are replaced with new sections. The removable frame portions can then be removed by removing the screws that hold it to the frame through the mounting tabs, and these sections of the frame can be replaced. Then, the process of reinstalling door hardware can be repeated as desired.

It should be understood, of course, that the foregoing relates to exemplary embodiments of the invention and that modifications may be made without departing from the spirit and scope of the invention as set forth in the following claims.

What is claimed is:

1. A training aid comprising:

a door comprising a front surface, a rear surface and an edge comprising a top, a bottom, a first side and a second side, wherein a first cutout is formed at the second side;

a first bracket secured to the door adjacent to the first cutout;

a first door insert disposed within the first cutout and secured to the first bracket by a fastener; and a door frame comprising a first upright, a second upright and a top, wherein the first side of the door is attached to the first upright by at least one hinge, wherein wherein the second upright comprises a lower member, an upper member and a detachable member secured to the upper member and the lower member by fasteners, wherein the detachable member aligns with the first cutout.

2. The training aid of claim 1, wherein the lower member and the upper member each comprises tabs having openings, wherein the detachable member comprises openings that align with the openings of the tabs, wherein the fasteners run through the aligned openings.

3. The training aid of claim 1, wherein the door further comprises a second cutout formed at the top.

4. The training aid of claim 3, further comprising a second bracket secured to the door adjacent to the second cutout, and a second door insert disposed within the second cut out and secured to the second bracket by a fastener.

5. The training aid of claim 4, wherein the door further comprises a third cutout formed at the top.

6. The training aid of claim 5, further comprising a third bracket secured to the door adjacent to the third cutout and a third door insert disposed within the third cutout and secured to the third bracket by a fastener.

7. The training aid of claim 1, wherein the first bracket comprises a first plate secured to the front surface of the door, wherein a portion of the first bracket protrudes beyond an inner edge of the first cut out and a second plate secured to the rear surface of the door, wherein a portion of the second bracket protrudes beyond the inner edge of the first cutout, wherein the portions each comprise openings sized to receive fasteners.

* * * * *